US010858968B2

(12) United States Patent
Scheidig et al.

(10) Patent No.: US 10,858,968 B2
(45) Date of Patent: Dec. 8, 2020

(54) HYDRAULIC CAMSHAFT ADJUSTER, AND METHOD FOR OPERATING THE HYDRAULIC CAMSHAFT ADJUSTER

(71) Applicant: Schaeffler Technologies AG & Co. KG, Herzogenaurach (DE)

(72) Inventors: Gerhard Scheidig, Oberasbach (DE); Jochen Thielen, Nuremberg (DE); Enno Schmitt, Kulmbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/624,218

(22) PCT Filed: Jun. 18, 2018

(86) PCT No.: PCT/DE2018/100567
§ 371 (c)(1),
(2) Date: Dec. 18, 2019

(87) PCT Pub. No.: WO2018/233764
PCT Pub. Date: Dec. 27, 2018

(65) Prior Publication Data

US 2020/0217229 A1 Jul. 9, 2020

(30) Foreign Application Priority Data

Jun. 19, 2017 (DE) ..... 10 2017 113 361

(51) Int. Cl.
*F01L 1/344* (2006.01)
*F01M 9/10* (2006.01)

(52) U.S. Cl.
CPC ... *F01L 1/3442* (2013.01); *F01L 2001/34426* (2013.01); *F01L 2001/34446* (2013.01); *F01L 2001/34456* (2013.01); *F01M 9/106* (2013.01)

(58) Field of Classification Search
CPC ..... F01L 1/3442; F01L 2001/34423; F01L 2001/34426; F01L 2001/34433;
(Continued)

(56) References Cited

U.S. PATENT DOCUMENTS

2002/0121253 A1* 9/2002 Hase ..... F01L 1/3442 123/90.17
2013/0199469 A1* 8/2013 Busse ..... F01L 1/3442 123/90.15

(Continued)

FOREIGN PATENT DOCUMENTS

DE 102012201558 A1 8/2013
DE 102012201566 A1 8/2013

(Continued)

*Primary Examiner* — Jorge L Leon, Jr.
(74) *Attorney, Agent, or Firm* — Matthew V. Evans

(57) ABSTRACT

A hydraulic camshaft adjuster adjusts the control time of gas exchange of an internal combustion engine. A reservoir for storing pressure medium is formed on a cover of the hydraulic camshaft adjuster. An overflow opening of the cover is dimensioned such that a volume of pressure medium remains in the reservoir when the hydraulic camshaft adjuster is stationary. This ensures that pressure medium is supplied to the return valve of a central locking mechanism when the engine is running.

18 Claims, 4 Drawing Sheets

(58) Field of Classification Search
CPC ... F01L 2001/34446; F01L 2001/34463; F01L 1/46; F01M 9/106
USPC ..... 123/90.15, 90.17, 90.38
See application file for complete search history.

(56) References Cited

U.S. PATENT DOCUMENTS

| | | | | |
|---|---|---|---|---|
| 2016/0053640 | A1* | 2/2016 | Schafer | F01L 1/047 123/90.17 |
| 2018/0238201 | A1* | 8/2018 | Asahi | F01L 1/3442 |

FOREIGN PATENT DOCUMENTS

| | | | |
|---|---|---|---|
| DE | 102016218793 | A1 | 6/2017 |
| WO | 2014204650 | A1 | 12/2014 |

* cited by examiner

HYDRAULIC CAMSHAFT ADJUSTER, AND METHOD FOR OPERATING THE HYDRAULIC CAMSHAFT ADJUSTER

CROSS-REFERENCE TO RELATED APPLICATIONS

This application is the U.S. National Phase of PCT Appln. No. PCT/DE2018/100567 filed Jun. 18, 2018, which claims priority to DE 10 2017 113 361.5 filed Jun. 19, 2017, the entire disclosures of which are incorporated by reference herein.

TECHNICAL FIELD

The disclosure concerns a hydraulic camshaft adjuster and a method for operating a hydraulic camshaft adjuster.

BACKGROUND

Hydraulic camshaft adjusters are used in internal combustion engines to adapt a load state of the internal combustion engine and hence increase the efficiency of the internal combustion engine. Hydraulic camshaft adjusters which work on the vane cell principle are known from the prior art. These camshaft adjusters generally comprise in their basic structure a stator which can be driven by a crankshaft of an internal combustion engine, and a rotor connected rotationally fixedly to the camshaft of the internal combustion engine. An annular chamber is situated between the stator and the rotor, and is divided by radially inwardly projecting protrusions, connected rotationally fixedly to the stator, into a plurality of working chambers, each of which is divided into two pressure chambers by a vane protruding radially outwardly from the rotor. Depending on the loading of the pressure chambers with a hydraulic pressure medium, the position of the rotor relative to the stator—and hence also the position of the camshaft relative to the crankshaft—can be shifted in the "advance" or "retard" direction. Hydraulic camshaft adjusters with a mid-position locking mechanism are known, in which the rotor can be locked in a middle position as well as in the respective end positions in order to facilitate engine start in particular. In exceptional cases, for example on stalling of the internal combustion engine, it is however possible that the locking device does not lock the rotor correctly and the camshaft adjuster must be operated with unlocked rotor in the subsequent start-up phase. Since however many internal combustion engines have very poor starting behavior when the rotor is not locked in the middle position, the rotor must be turned into the middle locking position automatically during the start-up phase and then locked. In addition, hydraulic camshaft adjusters with a storage volume are known, wherein the hydraulic working chambers for adjusting the rotor are supplied by the pressure medium pump from the storage volume in the case of inadequate supply, in order to prevent the intake of air into the corresponding working chambers and also to utilize the moments of the camshaft drive. Such a hydraulic camshaft adjuster is known as a smart phaser. If a hydraulic camshaft adjuster comprises both a mid-position locking mechanism and a storage volume, this camshaft adjuster is known as a smart lock camshaft adjuster.

Hydraulic camshaft adjusters with a storage volume for the pressure medium have a significantly lower pressure medium throughput and higher adjustment rates than conventional hydraulic camshaft adjusters. DE 10 2012 201 558 A1 discloses a hydraulic camshaft adjuster with several storage volumes, wherein the storage volumes are formed in the cavities of the rotor. DE 10 2012 201 566 A1 discloses a hydraulic camshaft adjuster with several storage volumes for conducting hydraulic oil into the working chambers of the camshaft adjuster, wherein the storage volumes are formed in the webs of the stator which separate the working chambers of the camshaft adjuster from each other. Check valves are provided on the storage volumes in order to eliminate an uncontrolled outflow of hydraulic oil into the working chambers of the camshaft adjuster. Furthermore, hydraulic camshaft adjusters are known in which a storage volume is formed in one of the covers of the hydraulic camshaft adjuster.

DE 10 2016 218 793 A1 discloses a camshaft adjuster with a drive element and a driven element which can be twisted relative thereto within an angular range and connected to a camshaft, wherein pressurizable working chambers are formed between the drive element and the driven element for twisting the drive element relative to the driven element; here, the camshaft adjuster has a storage volume for collecting hydraulic medium, wherein the storage volume supplies the hydraulic medium to a vacuum-loaded working chamber via a check valve, in that the vacuum in the working chamber opens the check valve, and the check valve is arranged in an axial position between the working chamber and the storage volume, wherein the storage volume is formed by a cover element connected rotationally fixedly to the drive element.

The disadvantage with the known solutions however is that they are either very complex and hence comparatively costly, or that under certain (unfavorable) operating conditions, it cannot be guaranteed that a support chamber for adjusting the camshaft adjuster into the middle position is adequately supplied with oil. Unfavorably, the pressure medium stored in the reservoir when the engine has stopped is limited to a specific fill level by the overflow to an actuating magnet of the hydraulic camshaft adjuster. Since, during operation, centrifugal force is necessary to keep the oil circulating in the entire annular store, at a standstill a majority of the oil flows out of the store via the overflow. On start-up therefore, initially only a small oil quantity is available. It cannot therefore be guaranteed that the bores for supplying oil to the working chamber and/or the mid-position locking mechanism are always adequately covered with pressure medium, and it cannot be reliably ensured that no air is drawn in. This is critical in particular on a start-up process of the internal combustion engine because during start-up, the challenge is to accelerate the pressure medium on the circulating track into the covers and hence ensure that the pressure medium radially covers the check valves for supplying pressure medium to the support chambers.

SUMMARY

It is desirable to provide a hydraulic camshaft adjuster with a mid-position locking mechanism which overcomes the disadvantages of the solutions known from the prior art, and in particular to improve the oil supply during the start-up phase in order to guarantee a functionally reliable start-up of the engine.

This objective may be achieved by a hydraulic camshaft adjuster for adjusting the control times of gas exchange valves of an internal combustion engine, with a stator which can be rotated in synchrony with the crankshaft of the internal combustion engine, and a rotor which is arranged so as be rotatable relative to the stator and which can rotate in synchrony with a camshaft. Here, several webs are provided on the stator and divide an annular chamber between the stator and the rotor into a plurality of pressure chambers. The rotor comprises a rotor hub and a plurality of vanes which extend radially outwardly from the rotor hub and divide the pressure chambers into two groups of working chambers, wherein the groups have different action directions and can be loaded by a pressure medium flowing respectively into and out of a pressure medium circuit. The hydraulic camshaft adjuster furthermore comprises a locking mechanism for locking the rotor in a middle position. The hydraulic camshaft adjuster, in particular the stator of the hydraulic camshaft adjuster, is at least partially closed on an at least one end face, preferably on both end faces, by a cover. A reservoir for storing the pressure medium is formed in one of the covers, wherein the cover comprises an overflow opening through which the pressure medium can emerge in the axial direction from the hydraulic camshaft adjuster. Here, the reservoir is dimensioned relative to the overflow opening such that, when the hydraulic camshaft adjuster is at a standstill, a pressure medium sump remains in the reservoir which, on start-up of the hydraulic camshaft adjuster, ensures the supply of pressure medium at least to the check valves of the locking mechanism.

The hydraulic camshaft adjuster makes it possible, after start-up of the internal combustion engine, to turn the rotor out of an arbitrary position into a middle position and hence facilitate engine start and the subsequent warm-up phase of the internal combustion engine. The oil for turning the rotor into the middle position is supplied to the corresponding working chambers from the reservoir of the hydraulic camshaft adjuster by a pressure medium pump. The quantity of pressure medium which can escape through the overflow opening is so low that, on start-up, the remaining pressure medium quantity is sufficient to fully cover the check valves of the mid-position locking device with pressure medium and avoid the intake of air through these check valves. This improves the turning of the rotor into the middle position after a cold start or restart of the internal combustion engine.

The check valves for supplying pressure medium to the mid-position locking mechanism are arranged on a first pitch circle diameter, and the check valves for supplying pressure medium to the working chambers are arranged on a second pitch circle diameter, wherein the first pitch circle diameter is larger than the second pitch circle diameter. After the engine start, the availability of the locking function has a greater priority than the smart phasing function. Therefore it is advantageous if, after the engine start, the check valves for the locking function are supplied with pressure medium more quickly than the check valves of the working chambers for the smart phasing function. The arrangement of the check valves for the locking chambers on a larger pitch circle diameter than the pitch circle diameter of the check valves for the other adjustment chambers achieves the preferred oil supply to the locking chambers, whereby the rotor can be turned to the middle locking position and locked there using the working principle of a hydraulic ratchet.

In an embodiment, it is provided that the cover on which the reservoir for storing the pressure medium is formed, is free from dead volumes. The term "dead volumes" designates regions from which the pressure medium cannot reach the check valves under centrifugal force and remains captured in these dead volumes. This may prevent pressure medium from collecting in one of the dead volumes on start-up, and hence not being pushed outward under centrifugal force. By reducing the dead volumes, the oil supply to the check valves can be improved, in particular in the start-up phase of the hydraulic camshaft adjuster.

In some embodiments, it is provided that on an end face, the stator is delimited by a locking cover and a reservoir cover, wherein the reservoir is formed on the reservoir cover. Because of the locking mechanism and the recesses in the locking cover required for this, the cover comprises comparatively many undercuts which may form dead volumes. It is therefore advantageous if the reservoir is formed in the reservoir cover.

Alternatively, it is advantageously provided that the locking cover and the reservoir cover are combined in one component, in order to be able to guarantee flow paths for the pressure medium to the locking mechanism which are as short as possible.

In some embodiments of the hydraulic camshaft adjuster, it is provided that a blocking element is formed on the cover on which the reservoir is formed, and blocks the inflow of pressure medium into a dead volume of the hydraulic camshaft adjuster. A blocking element may prevent the inflow of pressure medium into a dead volume, so that the risk of pressure medium collecting in the dead volume is reduced.

The blocking element may be formed in a pocket or in front of a pocket. A pocket on one of the covers may create a clear space for further components, in particular for screw connections or valve access points. The blocking element fills such a pocket or covers the inlet into such a pocket, so that a hydraulic connection from the reservoir to the dead volume is eliminated or the dead volume is hydraulically isolated from the reservoir.

The dead volume may be formed by an opening for check valves and/or as a recess for a screw connection. Screw connections and mounting chamfers are typical examples of dead volumes on a hydraulic camshaft adjuster in which pressure medium can collect after an engine stoppage or at the beginning of the start-up process. It is therefore provided that the corresponding cover is configured so as to prevent an inflow into these dead volumes.

On one of the covers, the reservoir may have a geometry deviating from a cylindrical form, in order to reduce a dead volume which retains pressure medium that cannot be used for oil supply to the mid-position locking mechanism in the start-up phase. A reservoir deviating from the cylindrical form allows corresponding regions to be cut out on the hydraulic camshaft adjuster, in particular on the stator, so as to avoid the reservoir overlapping with bores for a screw connection or recesses necessary for mounting. In this way, the entire pressure medium retained in the reservoir can be utilized, on a fresh start-up process of the internal combustion engine, for supplying the check valves with pressure medium and preventing the intake of air.

A method is proposed for operating a hydraulic camshaft adjuster, wherein when the internal combustion engine stops, the pressure medium collects in the reservoir, and when the internal combustion engine restarts, the pressure medium is flung out of the reservoir by centrifugal force onto an outer, substantially annular starting volume, wherein the check valves for supplying the locking mechanism are arranged in a region of the hydraulic camshaft adjuster which is covered by the substantially annular starting volume. This prevents the intake of air into the working chambers for turning the rotor to the middle locking position, and it is ensured that the rotor can be securely turned into the middle locking position using the working principle of a hydraulic ratchet.

The various embodiments described herein may advantageously be combined with each other unless specified otherwise in individual cases.

BRIEF DESCRIPTION OF THE DRAWINGS

The hydraulic camshaft adjuster and corresponding method is now explained in more detail below with reference to preferred exemplary embodiments and the associated drawings. The same components or components with the same function are designated by the same reference signs. The drawings show.

DETAILED DESCRIPTION

Figure 1:
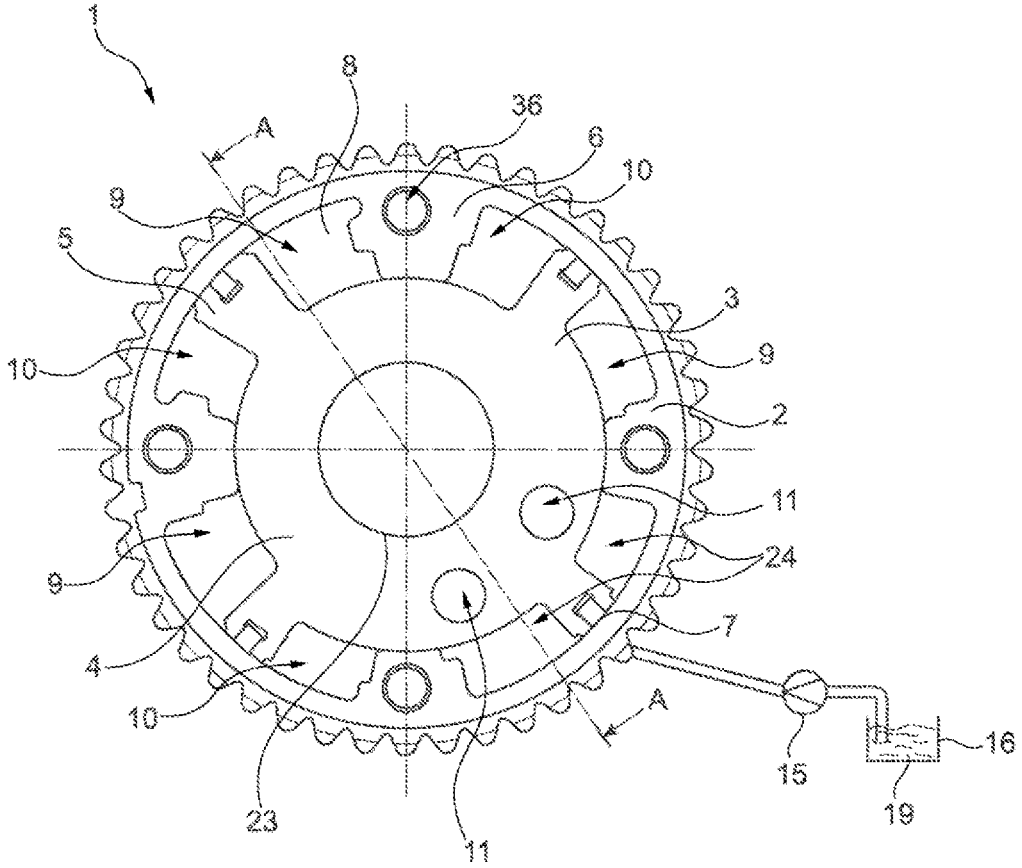
FIG. 1 an exemplary embodiment of a hydraulic camshaft adjuster in a sectional depiction.

FIG. 1 shows an exemplary embodiment of a hydraulic camshaft adjuster 1 for adjusting the valve control times of an internal combustion engine. The hydraulic camshaft adjuster 1 shown diagrammatically in FIG. 1 is configured as a vane cell adjuster in the known fashion, and comprises a stator 2 which can be driven by a crankshaft (not shown) of an internal combustion engine, and a rotor 3 which can be connected rotationally fixedly to a camshaft (also not shown). The rotor 3 has a rotor hub 4 from which several vanes 5 extend in the radial direction. In the depiction shown, the hydraulic camshaft adjuster 1 is shown in a sectional view through the stator 2 and the rotor 3. The stator 2 has a plurality of webs 6 which divide an annular chamber between the stator 2 and rotor 3 into several pressure chambers 8. The pressure chambers 8 are divided by the vanes 5 of the rotor 3 into two groups of working chambers 9, 10 with different action directions. Sealing elements 7 are provided at the tips of the vanes 5 to prevent overflow from one working chamber 9, 10 into the respective other working chamber 9, 10. The hydraulic camshaft adjuster 1 has a mid-position locking mechanism 11 which comprises a locking pin 13 for locking the rotor 3 relative to the stator 2 in a locking guide 12 fixed to the stator. The stator 2 is delimited on its first end face 20 by a locking cover 17 and a reservoir cover 18, and on its second end face 21 by a sealing cover 33, each of which is connected rotationally fixedly to the stator 2. The locking guide 12 may be arranged both in the stator 2 itself and also in one of the covers 17, 18 connected rotationally fixedly to the stator 2, in particular in the locking cover 17.

In principle, the rotary angle of the camshaft relative to the crankshaft in normal operation of the hydraulic camshaft adjuster 1 is adjusted in that the first group of working chambers 9 is loaded with a pressure medium 19, thereby increasing their volume, while simultaneously pressure medium 19 is displaced from a second group of working chambers 10, thereby reducing their volume. The working chambers 9 whose volume is increased in groups during this adjustment movement are designated, working chambers 9 with one action direction, while the working chambers 10 whose volume is simultaneously reduced are designated working chambers 10 with the opposite action direction. The volume increase of the working chambers 9 means that the rotor 3 is twisted in the advance direction relative to the stator 2. The corresponding supply of pressure medium to the working chambers 9, 10 takes place by a pressure medium pump 15 which conveys pressure medium 19 from a storage container 16 into the working chambers 9, 10 of the hydraulic camshaft adjuster 1.

A reservoir 14 for storing pressure medium 19 is formed on the rotor 3, on the stator 2 and/or on one of the covers 17, 18 of the hydraulic camshaft adjuster 1. The reservoir 14 is hydraulically connected to the working chambers 9, 10 and allows pressure medium 19 to flow into the working chambers 9, 10 if the pressure medium pump 15 cannot convey sufficient pressure medium 22 and a vacuum is created in one of the working chambers 9, 10. FIG. 1 shows a hydraulic camshaft adjuster 1 in which the reservoir is formed in the webs 6 of the stator 2, wherein the webs 6 may come into active connection with the working chambers 9, 10 of the hydraulic camshaft adjuster 1 via check valves 27, 28.

Figure 6:
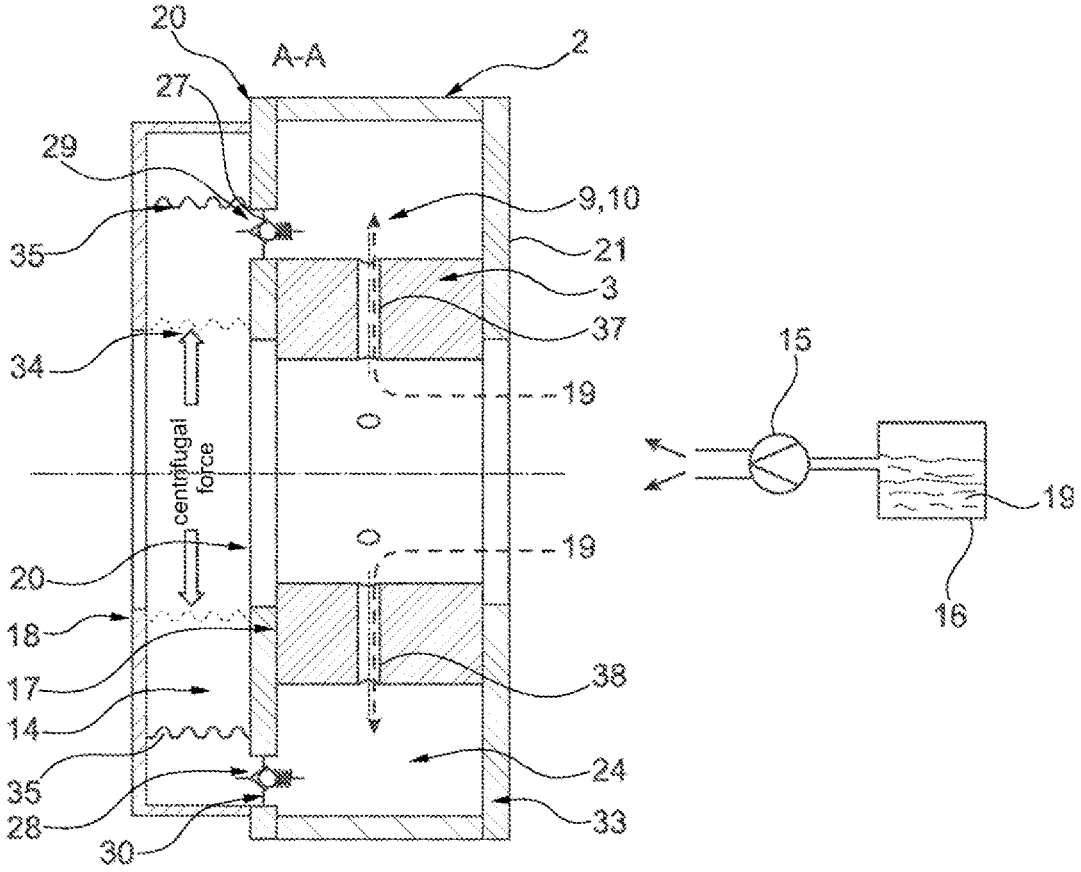
FIG. 6 a further sectional depiction through a hydraulic camshaft adjuster.

FIG. 6 shows a further section through a hydraulic camshaft adjuster 1. The hydraulic connection of the reservoir 14 to the working chambers 9, 10 of the hydraulic camshaft adjuster 1 can be seen. The locking cover 17 is here arranged between the first end face 20 of the stator 2 and the reservoir cover 18. Check valves 27 for supplying the working chambers 9, 10 for the smart phasing function of the hydraulic camshaft adjuster 1, and check valves 28 for supplying the supporting chambers 24, are formed in the locking cover 17. Oil is supplied to the working chambers 9, 10 in normal operation by the pressure medium pump 15 through a central valve (not shown) and corresponding supply bores 37, 38 in the rotor 3. Since the check valves 28 for the support chambers 24 lie on a larger pitch circle diameter 30 than the check valves 27 for the smart phasing function, it is guaranteed that the support function has priority over the adjustment function on start-up of the internal combustion engine.

Figure 2:
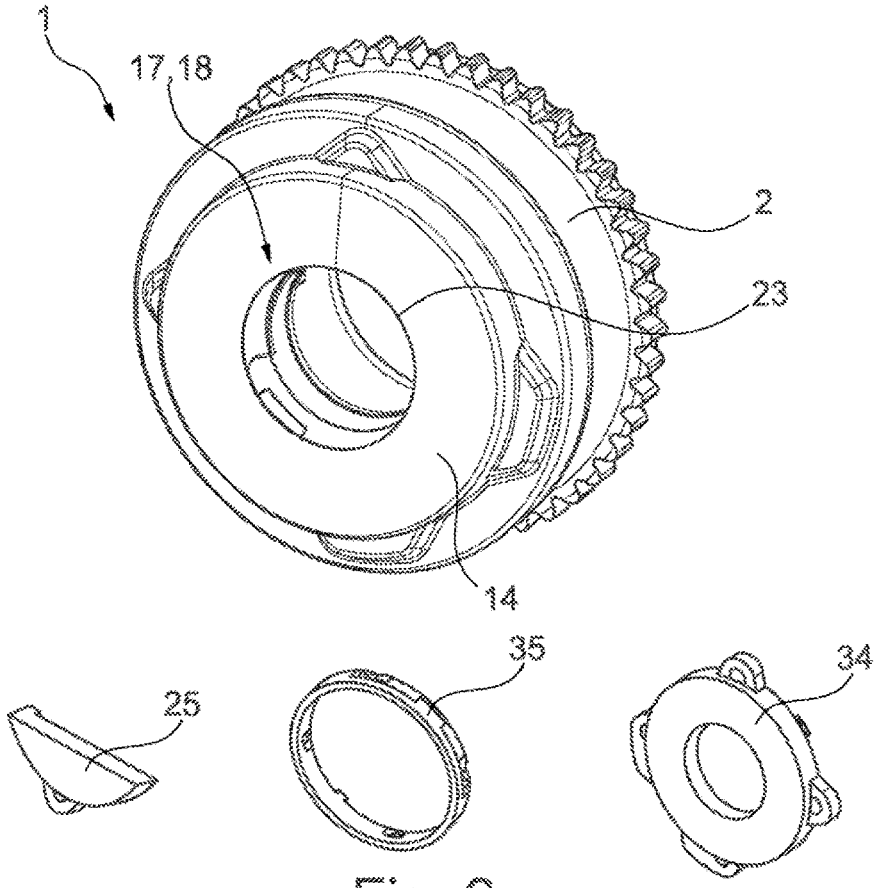
FIG. 2 a three-dimensional depiction of a cover of a hydraulic camshaft adjuster, and the distribution of pressure medium in various operating states.

FIG. 2 shows a three-dimensional depiction of a cover 17, 18 of a hydraulic camshaft adjuster 1 and the distribution of pressure medium in different operating states. The cover 17, 18 is rotationally fixedly attached to an end face 20, 21 of the hydraulic camshaft adjuster 1 and forms a reservoir 14 for storing pressure medium 19. When the internal combustion engine is at a standstill and the hydraulic camshaft adjuster 1 is also at a standstill, a partial quantity of the pressure medium 19 present in the reservoir 14, in particular the oil of the internal combustion engine, flows out of the reservoir 14 via the overflow opening 23, so that after a short time, a pressure medium sump 25 is formed which extends up to the lower edge of the overflow opening 23. On subsequent start-up of the internal combustion engine 1, the hydraulic camshaft adjuster is set in rotation by the crankshaft of the internal combustion engine so that the pressure medium 19 is displaced outwardly by the centrifugal force and bears on the wall of the cover 18 along a substantially annular portion. The pressure medium volume during start-up 35 corresponds to the pressure medium volume of the pressure medium sump 25. On further operation of the hydraulic camshaft adjuster 1, the reservoir 14 is filled further, whereby the annular portion widens and the reservoir 14 is filled from the outside towards the inside, until the additional pressure medium emerges again through the overflow opening 23 when the reservoir 14 is completely filled. The pressure medium volume increases to the pressure medium volume 34 shown in FIG. 2 for continuous engine operation.

Figure 3:
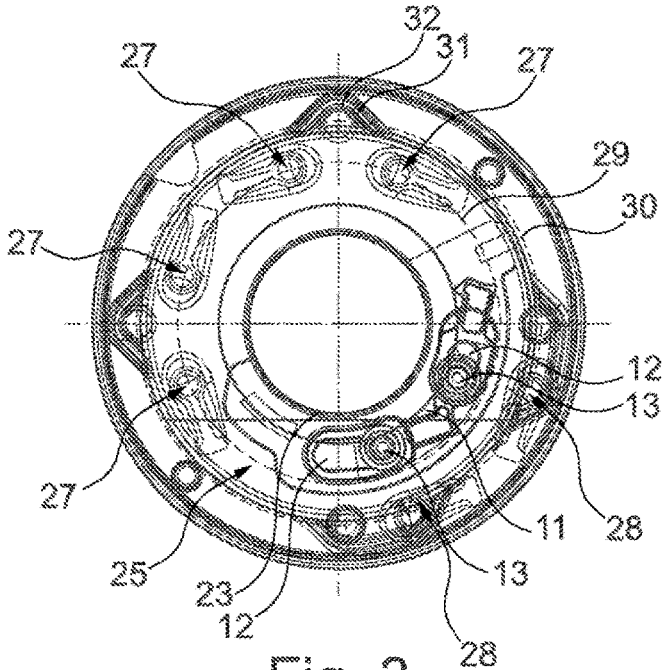
FIG. 3 a sectional depiction through a hydraulic camshaft adjuster and the pressure medium sump with the internal combustion engine switched off.

FIG. 3 shows a section through a hydraulic camshaft adjuster 1. It is evident that the check valves 28 for the mid-position locking mechanism 11 lie on a first pitch circle diameter 30, and the check valves 27 for the smart phasing function lie on a second pitch circle diameter 29 with a smaller diameter. Access points to the working chambers 9, 10 for the locking mechanism also lie on the first pitch circle diameter DA and are covered by the check valves 28. When the internal combustion engine has stopped, the pressure medium sump 25 (shown in FIG. 3) forms in the reservoir 14 of the cover 17, 18. FIG. 3 also shows the locking pins 13 and locking guide 12 of the mid-position locking mechanism 11.

Figure 4:
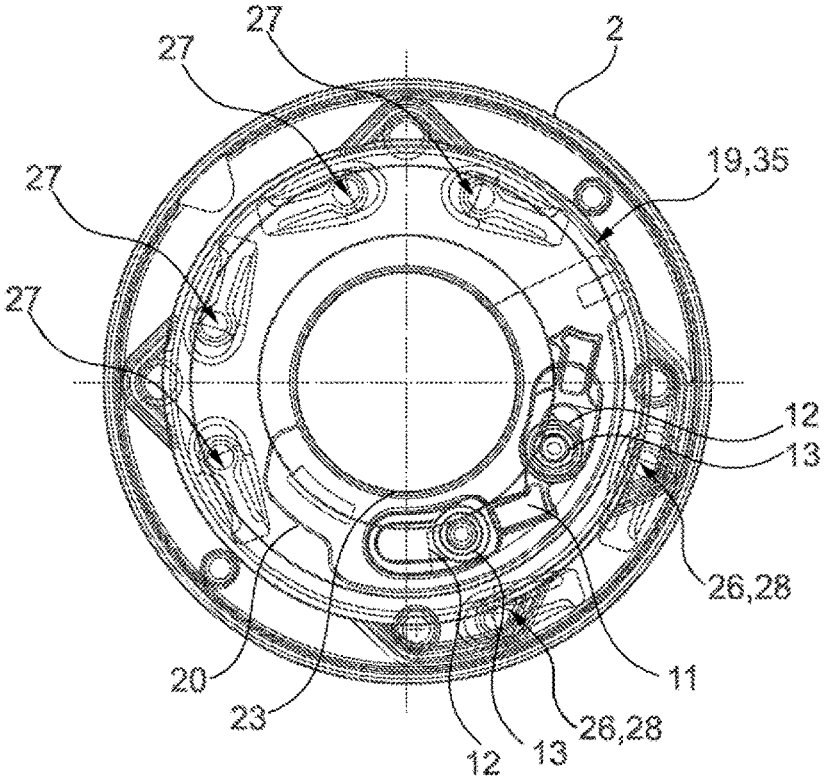
FIG. 4 a further sectional depiction through a hydraulic camshaft adjuster and the pressure medium distribution after a start-up of the internal combustion engine.

FIG. 4 shows a further section through a hydraulic camshaft adjuster 1, wherein the hydraulic camshaft adjuster 1 rotates at the rotation speed of the camshaft, i.e. at half the rotation speed of the crankshaft, after a start-up of the internal combustion engine. The pressure medium 19 is pressed radially outward under centrifugal force to an edge of the cover 17, 18 so that an annular volume 35 in the cover is covered with pressure medium 19, the volume of which substantially corresponds to the pressure medium volume of the pressure medium sump 25. The access points to the support chambers 24 for the locking mechanism 11 are here covered by pressure medium 19, so that the support chambers 24 cannot draw in air. In this way, the rotor 3 of the hydraulic camshaft adjuster 1 can be supported against the alternating moments of the camshaft and move into the middle locking position.

Since it is known from experience that situations occur in which the hydraulic camshaft adjuster 1 is no longer able to turn the rotor 3 into the middle locking position and lock the locking pins 13 in the locking guide 12 after the internal combustion engine has stopped, the possibility of adjustment from an arbitrary position into the middle locking position on engine start-up has been considered in the hydraulic camshaft adjuster 1. For this, the support chamber 24, which is preferred according to the desired/released adjustment direction, must be supplied with pressure medium 19 which can be drawn out of the reservoir 14 only via a check valve 28. Unfavorably, with the engine stopped, the pressure medium 19 stored in the reservoir 14 is limited by the overflow opening 23 to a magnet for controlling a central valve of the hydraulic camshaft adjuster 1. The remaining pressure medium 19 thus flows through the overflow opening 23 to a central magnet of the hydraulic camshaft adjuster 1. It cannot therefore be guaranteed that, when the hydraulic camshaft adjuster 1 is at a standstill, all bores and check valves 27, 28 are coated with pressure medium 19. In order to utilize the existing pressure medium volume 25, 35 optimally, it is advantageous to minimize the volume which cannot be drawn up—or only drawn up while mixing with air—by the check valves 28. This volume is designated a dead volume 22. Therefore in the exemplary embodiment depicted, pockets 32 are provided in the cover 17, 18. The pockets 32 are arranged at locations on the cover 17, 18 where for example screws protrude into the cover 17, 18. In addition, dead volumes 22 are formed on the hydraulic camshaft adjuster 1 in the region in which intake bores for the check valves 27, 28 are formed. The cover 17, 18, or the reservoir 14 delimited by the cover 17, 18, does not simply have a cylindrical form but deliberately deviates from this form. On operation following start-up, the reservoir 14 is filled with pressure medium via the central valve of the hydraulic camshaft adjuster 1 until the check valves 27 for supplying the working chambers 9, 10 for the smart phasing function are also covered by pressure medium and can therefore be activated. The reservoir 14 is here filled effectively "from outside to inside", i.e. the pressure medium ring formed by centrifugal force becomes wider over the operating period until surplus pressure medium 19 can again flow out via the overflow opening 23 in the direction of the central magnet.

Figure 5:
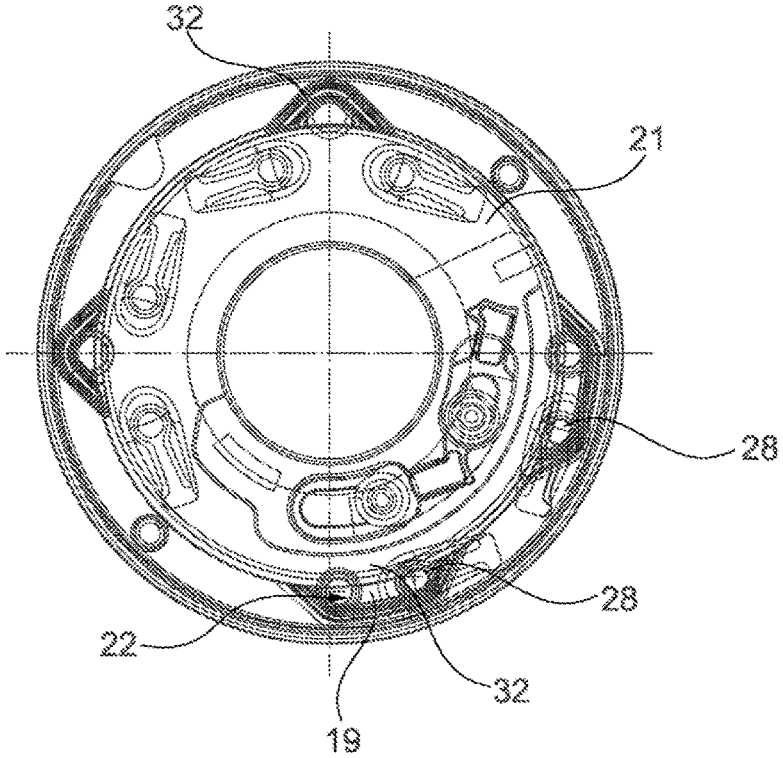
FIG. 5 a further sectional depiction through a hydraulic camshaft adjuster to illustrate a dead volume.

FIG. 5 shows a further section through a hydraulic camshaft adjuster 1. A dead volume 22 is formed on the hydraulic camshaft adjuster 1, which can retain pressure medium 19 that is not available at the edge of the cover 17, 18 under centrifugal forces on rotation of the hydraulic camshaft adjuster. In order to avoid this, a blocking element 31 may be provided on the cover 17, 18 which blocks an inflow of pressure medium 19 into a pocket 32 or at least partially fills such a pocket 32 in order to reduce the dead volume 22. This dead volume 22 could otherwise fill with pressure medium 19 on immersion into the pressure medium sump 25 or under the centrifugal force on start-up of the hydraulic camshaft adjuster 1, wherein the pressure medium 19 in the dead volume 22 is not then available to supply pressure medium to the working chambers 9, 10. To prevent this, the pocket 32 is formed on the cover 17, 18, whereby the reservoir 14 has a form deviating from a cylindrical form and blocks a hydraulic connection from the reservoir 14 to the dead volume 22.

In a hydraulic camshaft adjuster 1, it is therefore possible to turn the rotor 3 from an arbitrary starting position into the middle locking position and lock it there. The pressure medium supply of the hydraulic camshaft adjuster 1 is thus improved, in particular in the start-up phase of the hydraulic camshaft adjuster 1 following start-up of the internal combustion engine.

LIST OF REFERENCE SIGNS

1 Hydraulic camshaft adjuster
2 Stator
3 Rotor
4 Rotor hub
5 Vane
6 Web
7 Annular chamber
8 Pressure chamber
9 Working chamber
10 Working chamber
11 Mid-position locking mechanism
12 Locking guide
13 Locking pin
14 Reservoir
15 Pressure medium pump
16 Storage container
17 Locking cover
18 Reservoir cover
19 Pressure medium
20 First end face
21 Second end face
22 Dead volume
23 Overflow opening
24 Support chamber
25 Pressure medium sump
26 Inlet bore
27 Check valve
28 Check valve
29 First pitch circle diameter
30 Second pitch circle diameter
31 Blocking element
32 Pocket

33 Sealing cover
34 Oil level in continuous engine operation
35 Oil level during start-up
36 Screw

The invention claimed is:

1. A hydraulic camshaft adjuster for adjusting the control times of gas exchange valves of an internal combustion engine, the hydraulic camshaft adjuster comprising:

a stator which is configured to rotate in synchrony with a crankshaft of the internal combustion engine;

a rotor arranged within the stator so as to rotate relative to the stator and in synchrony with a camshaft; and a mid-position locking mechanism for locking the rotor in a middle position;

wherein;

a plurality of webs is provided on the stator which divides an annular chamber between the stator and the rotor into a plurality of pressure chambers;

the rotor comprises a rotor hub and a plurality of vanes which extend radially outwardly from the rotor hub and respectively divide each pressure chamber into a first working chamber and a second working chamber, wherein the first working chamber and the second working chamber act in opposing directions in response to a pressure medium flowing alternately into and out of a pressure medium circuit;

the stator is partially closed on an end face by at least one cover;

a reservoir configured to store the pressure medium is formed in the at least one cover;

the at least one cover defines an overflow opening configured to allow the pressure medium to emerge in an axial direction of the stator;

the reservoir and the overflow opening are dimensioned such that, when the hydraulic camshaft adjuster is at a standstill, a volume of the pressure medium remains in a pressure medium sump of the reservoir which ensures a sufficient supply of the pressure medium to the mid-position locking mechanism, via first check valves, upon start up of the hydraulic camshaft adapter;

the first check valves are arranged along a first pitch circle of the at least one cover;

second check valves configured to supply the pressure medium to the first and second working chambers are arranged along a second pitch circle of the at least one cover; and the first pitch circle is larger than the second pitch circle.

2. The hydraulic camshaft adjuster as claimed in claim 1, wherein the reservoir is free from dead volumes.

3. The hydraulic camshaft adjuster as claimed in claim 1, wherein the at least one cover comprises a locking cover and a reservoir cover, wherein the reservoir is formed on the reservoir cover.

4. The hydraulic camshaft adjuster as claimed in claim 3, wherein a pocket is formed on the reservoir cover.

5. The hydraulic camshaft adjuster as claimed in claim 4, wherein a blocking element is formed on the at least one cover and wherein the blocking element eliminates an inflow of the pressure medium into the pocket.

6. The hydraulic camshaft adjuster as claimed in claim 1, wherein a blocking element is formed on the at least one covers which blocks an inflow of the pressure medium into a dead volume.

7. The hydraulic camshaft adjuster as claimed in claim 6, wherein the dead volume is formed by an access opening of the first or second check valves or by a recess for a screw connection.

8. The hydraulic camshaft adjuster as claimed in claim 1, wherein the reservoir has a non-cylindrical geometry so as to reduce a dead volume of the pressure medium that cannot be used for oil supply to the mid-position locking mechanism in a start-up phase.

9. A hydraulic camshaft adjuster comprising:

a stator having a plurality of inwardly projecting webs;

a rotor having a plurality of outwardly projecting vanes interspersed with the plurality of inwardly projecting webs so as to define a plurality of working chambers;

a locking cover fixed to the stator and including a locking mechanism; and a reservoir cover fixed to the stator and defining an annular reservoir;

a plurality of first check valves configured to supply pressure medium from the reservoir to the plurality of working chambers, the plurality of first check valves located a first distance from an axis of rotation of the stator; and a second check valve configured to supply the pressure medium from the reservoir to the locking mechanism, the second check valve located a second distance greater than the first distance from the axis of rotation.

10. The hydraulic camshaft adjuster of claim 9 wherein the locking mechanism is a mid-position locking mechanism.

11. The hydraulic camshaft adjuster of claim 9 wherein:

the reservoir cover defines an overflow opening;

the overflow opening is dimensioned such that a volume of the pressure medium remains in the reservoir when the stator is stationary; and the volume is sufficient to radially cover the second check valve when the stator rotates.

12. The hydraulic camshaft adapter of claim 11 wherein the reservoir cover is free from dead volumes.

13. The hydraulic camshaft adapter of claim 11 further comprising a blocking element configured to block an inflow of the pressure medium into a dead volume of the reservoir cover.

14. The hydraulic camshaft adapter of claim 11 wherein the reservoir cover includes a pocket configured to accommodate the plurality of first check valves, the second check valve, or a screw connection.

15. The hydraulic camshaft adapter of claim 14 further comprising a blocking element configured to block an inflow of the pressure medium into the pocket.

16. A hydraulic camshaft adjuster comprising:

a stator having a plurality of inwardly projecting webs;

a rotor having a plurality of outwardly projecting vanes interspersed with the plurality of inwardly projecting webs so as to define a plurality of working chambers;

a locking cover fixed to the stator and including a locking mechanism; and a reservoir cover fixed to the stator and defining an annular reservoir; and a first check valve configured to supply pressure medium from the reservoir to the locking mechanism, the first check valve located a first distance from an axis of rotation of the stator; wherein:

the reservoir cover defines an overflow opening;

the overflow opening is dimensioned such that a volume of the pressure medium remains in the reservoir when the stator is stationary; and the volume is sufficient to radially cover the first check valve when the stator rotates.

17. The hydraulic camshaft adjuster of claim 16 wherein the locking mechanism is a mid-position locking mechanism.

18. The hydraulic camshaft adjuster of claim 17 further comprising a plurality of second check valves configured to supply the pressure medium from the reservoir to the plurality of working chambers, the plurality of second check valves located a second distance, less than the first distance, from the axis of rotation.

* * * * *